US010643600B1

(12) United States Patent
Aryal

(10) Patent No.: US 10,643,600 B1
(45) Date of Patent: May 5, 2020

(54) MODIFYING SYLLABLE DURATIONS FOR PERSONALIZING CHINESE MANDARIN TTS USING SMALL CORPUS

(71) Applicant: Sandesh Aryal, Kathmandu (NP)

(72) Inventor: Sandesh Aryal, Kathmandu (NP)

(73) Assignee: OBEN, INC., Pasadena, CA (US)

( * ) Notice: Subject to any disclaimer, the term of this patent is extended or adjusted under 35 U.S.C. 154(b) by 0 days.

(21) Appl. No.: 15/917,418

(22) Filed: Mar. 9, 2018

Related U.S. Application Data

(60) Provisional application No. 62/469,457, filed on Mar. 9, 2017.

(51) Int. Cl.

| | |
|---|---|
| ***G10L 13/00*** | (2006.01) |
| ***G10L 13/02*** | (2013.01) |
| ***G10L 13/08*** | (2013.01) |
| ***G10L 13/10*** | (2013.01) |

(52) U.S. Cl.
CPC ..... *G10L 13/02* (2013.01); *G10L 13/086* (2013.01); *G10L 13/10* (2013.01)

(58) Field of Classification Search
None
See application file for complete search history.

(56) References Cited

U.S. PATENT DOCUMENTS 5,651,095 A * 7/1997 Ogden ..... G10L 13/10 704/260
5,852,802 A * 12/1998 Breen ..... G10L 13/047 704/260
6,094,633 A * 7/2000 Gaved ..... G10L 13/08 704/260
2005/0005266 A1* 1/2005 Datig ..... G06F 17/279 717/136
2007/0219933 A1* 9/2007 Datig ..... G06F 17/279 706/4

* cited by examiner

*Primary Examiner* — Satwant K Singh
(74) *Attorney, Agent, or Firm* — Andrew S. Naglestad

(57) ABSTRACT

A method and system for personalizing synthetic speech from a text-to-speech (TTS) system is disclosed. The method uses linguistic feature vectors to correct/modify the synthetic speech, particularly Chinese Mandarin speech. The linguistic feature vectors are used to generate or retrieve onset and rime scaling factors encoding differences between the synthetic speech and a user's natural speech. Together, the onset and rime scaling factors are used to modify every word/syllable of the synthetic speech from a TTS system, for example. In particular, segments of synthetic speech are either compressed or stretched in time for each part of each syllable of the synthetic speech. After modification, the synthetic speech more closely resembles the speech patterns of a speaker for which the scaling factors were generated. The modified synthetic speech may then be transmitted to a user and played to the user via a mobile phone, for example. The linguistic feature vectors are constructed based on a plurality of feature attributes including at least a group ID attribute, voicing attribute, complexity attribute, nasality attribute, and tone for the current syllable. The invention is particularly useful when the user speech corpus is either small or otherwise incomplete.

14 Claims, 5 Drawing Sheets

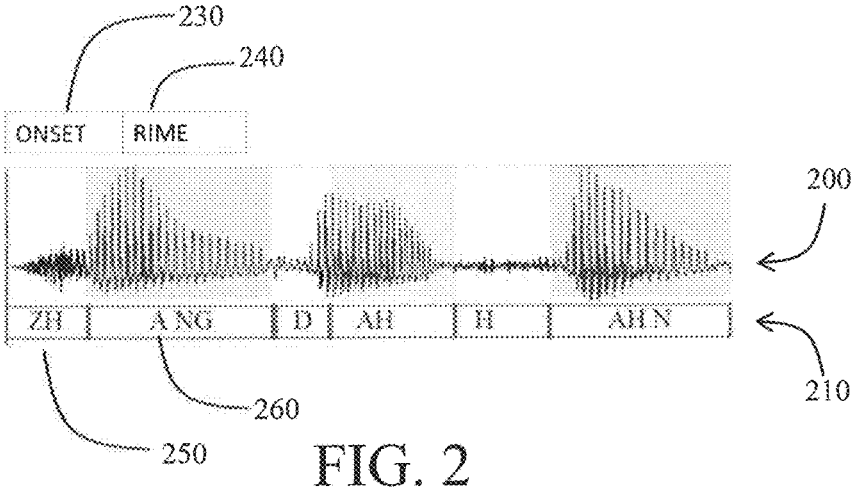
FIG. 2
FIG. 6
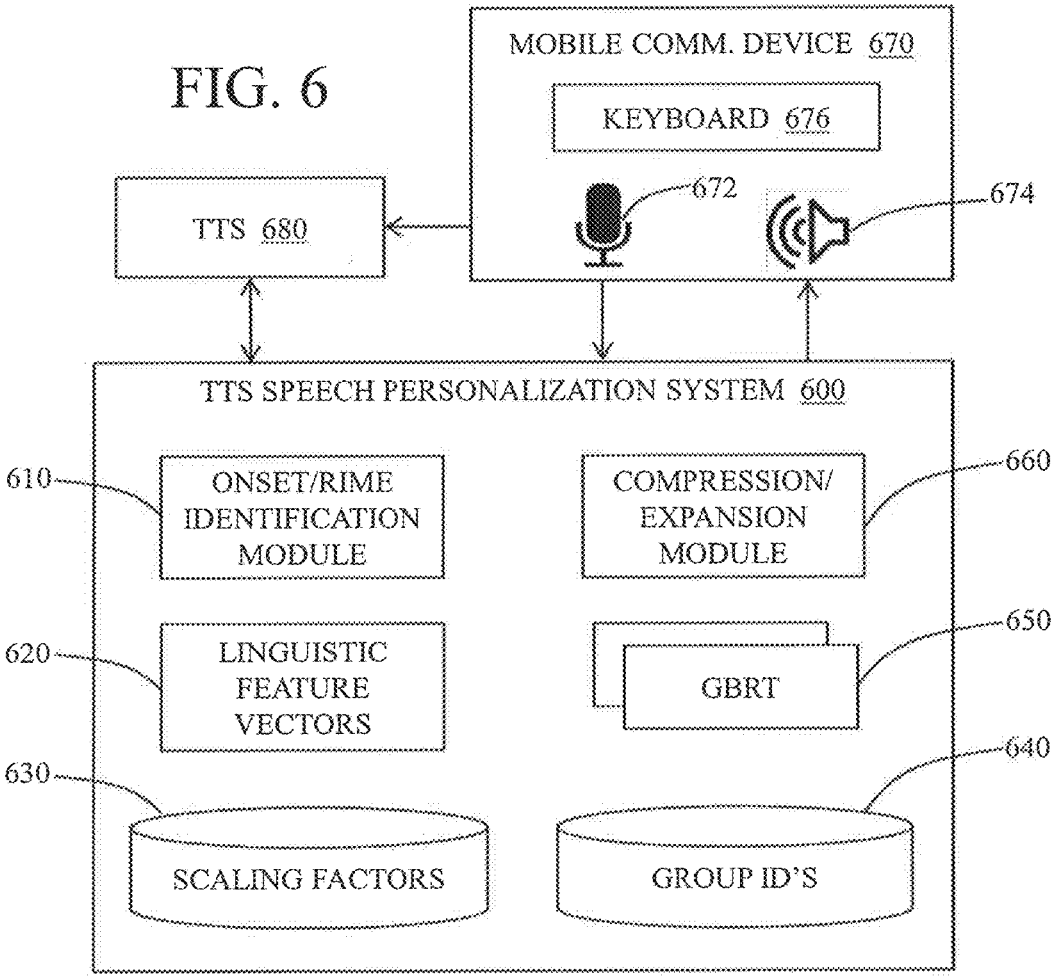

TABLE 1

| onsets | Group id |
|---|---|
| NULL | 0 |
| B | 1 |
| C | 5 |
| CH | 5 |
| D | 1 |
| F | 2 |
| G | 1 |
| H | 2 |
| J | 7 |
| K | 6 |
| L | 3 |
| M | 3 |
| N | 3 |
| NG | 3 |
| P | 6 |
| Q | 5 |
| R | 3 |
| S | 2 |
| SH | 2 |
| T | 6 |
| X | 2 |
| Z | 7 |
| ZH | 7 |
| SIL | 10 |
| $ | 10 |

TABLE 2A

| rimes | Group id vector | | |
|---|---|---|---|
| | voicing group id | complexity group id | nasality group id |
| A | 1 | 0 | 0 |
| AI | 1 | 1 | 0 |
| AN | 1 | 0 | 1 |
| ANG | 1 | 0 | 2 |
| AU | 1 | 1 | 0 |
| EY | 2 | 1 | 0 |
| EI | 2 | 1 | 0 |
| AHN | 1 | 0 | 1 |
| ANNG | 1 | 0 | 2 |
| AHNG | 1 | 0 | 2 |
| I | 3 | 0 | 0 |
| IEN | 7 | 2 | 1 |
| IAU | 1 | 3 | 0 |
| IE | 3 | 2 | 0 |
| IN | 3 | 0 | 1 |
| ING | 3 | 0 | 2 |
| UO | 4 | 2 | 0 |
| U | 4 | 0 | 0 |
| AH | 1 | 0 | 0 |
| IH | 5 | 0 | 0 |
| ONG | 6 | 0 | 2 |
| OU | 4 | 2 | 0 |
| UA | 1 | 2 | 0 |
| UAI | 1 | 2 | 0 |
| UAN | 1 | 2 | 1 |

TABLE 2B

| rimes | Group id vector | | |
|---|---|---|---|
| | voicing group id | complexity group id | nasality group id |
| UANG | 1 | 2 | 2 |
| UEI | 2 | 2 | 0 |
| UAHN | 1 | 2 | 1 |
| IA | 1 | 2 | 0 |
| IOU | 4 | 3 | 0 |
| E | 7 | 0 | 0 |
| ER | 1 | 1 | 0 |
| M | 0 | 0 | 1 |
| NG | 0 | 0 | 2 |
| IANG | 1 | 2 | 2 |
| IONG | 9 | 2 | 2 |
| Y | 8 | 0 | 0 |
| YEN | 7 | 2 | 1 |
| YE | 7 | 2 | 0 |
| YN | 8 | 2 | 1 |
| O | 9 | 0 | 0 |
| UAHNG | 1 | 2 | 2 |
| IAI | 1 | 2 | 0 |
| IO | 9 | 2 | 0 |
| EN | 7 | 0 | 1 |
| N | 0 | 0 | 1 |
| NULL | 10 | 10 | 10 |
| $ | 10 | 10 | 10 |
| | | | |
| | | | |

FIG. 5

MODIFYING SYLLABLE DURATIONS FOR PERSONALIZING CHINESE MANDARIN TTS USING SMALL CORPUS

CROSS-REFERENCE TO RELATED APPLICATION(S)

This application claims the benefit of U.S. Provisional Patent Application Ser. No. 62/469,457 filed Mar. 9, 2017, titled "Modifying syllable durations for personalizing Chinese Mandarin TTS using small corpus," which is hereby incorporated by reference herein for all purposes.

TECHNICAL FIELD

The invention generally relates to the field of synthetic voice production. In particular, the invention relates to a technique for using generic synthetic voice data to produce speech signals that resemble a user's voice.

BACKGROUND

Text-to-speech (TTS) synthesis refers to a technique for generating synthetic speech that is artificially produced. The synthetic speech is generally composed by a computer system and designed to sound like human speech. Another technique, referred to as the Personalization of TS, seeks to modify the synthesized speech from the TTS system to sound like a target speaker. One of the challenges in doing so is to match the rhythm and speaking style using a small amount of data generally limited to a small number of utterances from that speaker. As a result, the syllable durations of a typical speaker do not match the syllable durations of a TTS system output for the same sentence.

The mismatch between a typical speaker and corresponding TTS output is illustrated in FIG. 1, which shows the waveform 100 and spectrum 110 of speech signal from a representative speaker (top) and the waveform 120 and spectrum 130 of same sentence generated by a TTS system (bottom). As is evident from the speech boundary lines 140 in FIG. 1, the difference in syllable durations associated with the speaker are sometimes longer and sometimes shorter than the TTS output for the same sentence. The temporal duration of different segments of the speech vary widely depending on the linguistic contexts such as the phonetic contents of the syllable, preceding and following syllables, and the tones of these syllables. Even within a syllable, uniform expansion or compression is not sufficient to address the individual differences necessary to adapt the synthetic speech to the speaker.

There is therefore a need for a technique for adapting the TTS system speech to match the target speaker, thereby generating synthetic speech that realistically sounds like the target speaker.

SUMMARY

The invention in the preferred embodiment is a method and system for personalizing synthetic speech from a text-to-speech (TTS) system. The method comprises: recording target speech data having a plurality of words with onsets and rimes; generating synthetic speech data with the same set of words; identifying pairs of onsets and rimes in the target speech; determining the durations of the onsets and rimes in the target speech and synthetic speech data; generating a plurality of onset scaling factors and rime scaling factors; generating linguistic feature vector for the plurality of words; associating each of the linguistic feature vector with an onset and rime scaling factor; receiving target text comprising a second plurality of words; identifying pairs of onsets and rimes for the second plurality of words; generating a linguistic feature vector for each of the second plurality of words; identifying onset and rime scaling factors based on the linguistic feature vectors for the second plurality of words; generating synthetic speech based on the target text; compressing or expanding the duration of each onset and rime for the second plurality of words in the synthetic speech based on the identified onset scaling factor and rime scaling factor, generating a waveform from the onsets and rimes with compressed or expanded durations; and playing the waveform to a user. In this embodiment the target speech data substantially consists of Chinese Mandarin speech, and the target text substantially consists of Chinese Mandarin words.

Each linguistic feature vector is associated with a current syllable and comprises a plurality of onset and rime feature attributes, including a group ID attribute, voicing attribute, complexity attribute, and nasality attribute for the current syllable. The group ID attribute is assigned a value from among 10 different groups or categories. The voicing attribute is assigned a value associated with one of a plurality of voicing categories where the categories differ in the frequency domain representation of the rime, namely the positions of formants in the frequency domain. The complexity attribute is assigned a value associated with one of a plurality of complexity categories based on the number of vowels in the rime. The nasality attribute assigned a value associated with one of a plurality of nasality categories based on the composition of consonants in the rime.

The linguistic feature vector described above is used to characterize and categorize the onset and rime of a given syllable referred to herein as the "current" syllable. A different linguistic feature vector is generated for each syllable in the target speech data and target text. In some embodiments, the linguistic feature vectors further include an onset feature attribute and a plurality of rime feature attributes characterizing the syllable preceding the current syllable to provide context. The linguistic feature vectors may further include an onset feature attribute and a plurality of rime feature attributes characterizing the syllable following the current syllable for additional context.

BRIEF DESCRIPTION OF THE DRAWINGS

The present invention is illustrated by way of example and not limitation in the figures of the accompanying drawings, and in which:

FIG. 2 is a waveform for a Chinese Mandarin speech signal;

FIG. 5 illustrates tables of values of categories of feature attributes for generating linguistic feature vectors, in accordance with a preferred embodiment of the present invention; and FIG. 6 is functional block diagram of the TTS speech personalization system, in accordance with a preferred embodiment of the present invention.

DETAILED DESCRIPTION OF THE PREFERRED EMBODIMENT

The invention features a speech personalization system and method for generating realistic-sounding synthetic speech. In the preferred embodiment, the speech signal of a Test-to-Speech (TTS) system is corrected to emulate a particular target speak. That is, the speech signal, after modification with a plurality of scaling factors, accurately reflects the voice and speech patterns of a target speaker while retaining the words of the TTS input. In the preferred embodiment, the TTS system applies the plurality of scaling factors to generate appropriate compression or expansion to segments of speech signal outputted from the TTS. Compression is represented by a scaling factor less than 1 and expansion is represented by a scaling factor greater than or equal to 1.

In the preferred embodiment, the synthetic speech signal from the TTS system is spoken in the Chinese language. As illustrated in FIG. 2, a waveform 200 of speech signal speaking in Chinese Mandarin includes a plurality of syllables 210. In some, but not all cases, a syllable may be broken down into two parts, namely an onset 230 and a rime 240. Here, the set of onsets includes the sounds denoted ZH 250, D, and H. The set of rimes includes the sounds denoted A NG 260, AH, and AH-N.

Figure 3:
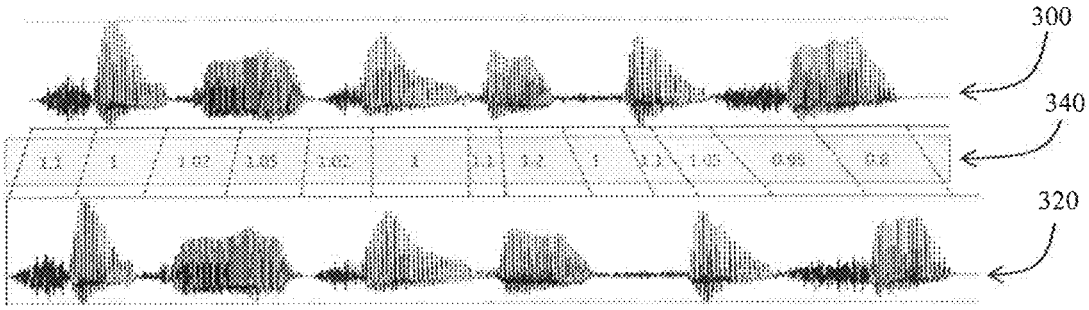
FIG. 3 shows a speech signal from a representative speaker and a modified waveform after corrections of the TTS output signal, in accordance with a preferred embodiment of the present invention.

As illustrated in the corrected TTS speech signal in FIG. 3, the scaling factors are applied to modify the duration of each onset and rime independently. In the preferred embodiment, different scaling factors are applied in order to compress or expand the duration of the onset and rime segment of each syllable. For example, the first syllable (ZH-A-NG) shown in FIG. 2, the onset segment (ZH) and rime segments (A NG) may be compressed or expanded independently from one another. After correction with scaling factors 340, the waveform 320 of the corrected TTS speech signal 320 closely matches the speech pattern of a typical speaker, which is shown in the waveform 300. When trained on the speech of a target speaker, the modified TTS speech signal sounds more natural and closely resembles the speech of the target speaker.

Figures 4A, 4B:
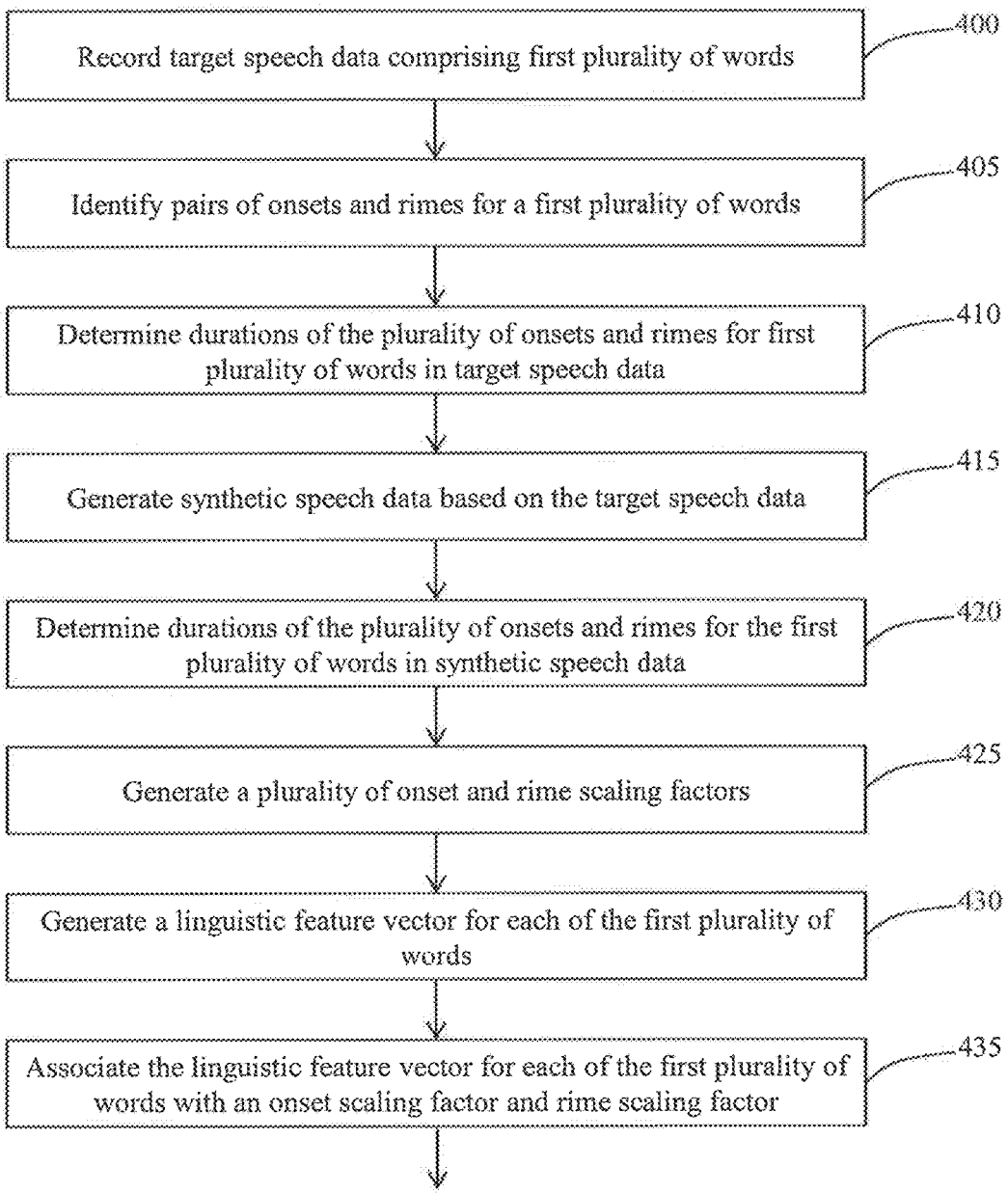
FIGS. 4A and 4B is a method of generating scaling factors based on linguistic features and applying the scaling factors to compress or expand TTS output segments, in accordance with a preferred embodiment of the present invention.
Figures 4A, 4B:
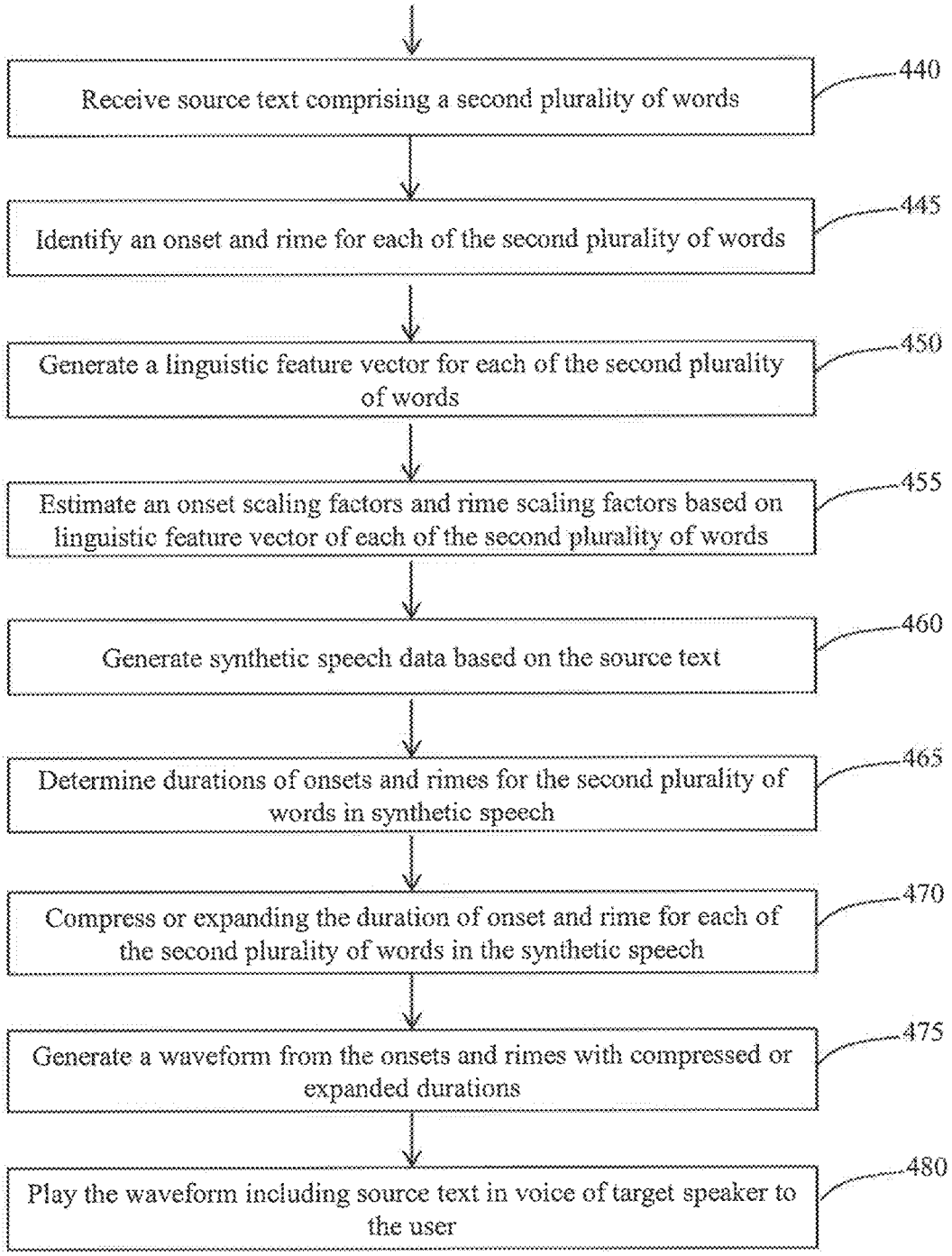

Illustrated in FIGS. 4A and 4B is the method of generating a plurality of scaling factors based on linguistic features, and then applying the scaling factors to compress or expand the segments in TTS output. First, the speech data from a target speaker is recorded 400 or otherwise acquired from a user with a mobile phone, for example. The speech data generally consists of several sentences spoken by the user. The sentences comprise words but the number of words is low, i.e., the corpus is small. As a result, the data set is generally insufficient to fully model the speaker's voice and speech patterns. This is due to the fact that the target speech data is incomplete to the extent that some examples of onsets, rimes, and combinations of onsets and rimes are absent from the data set. The present invention overcomes this problem in the manner described below.

The target speech data is then decomposed and pairs of onsets and rimes identified 405 for all the words (or syllables) of the target speech data. The duration of each pair of onset and rime is then determined 410 and denoted $\{d_{spk_o}, d_{spk_r}\}$. The duration refers the length of the phoneme as measured in time, preferably seconds.

Figure 1:
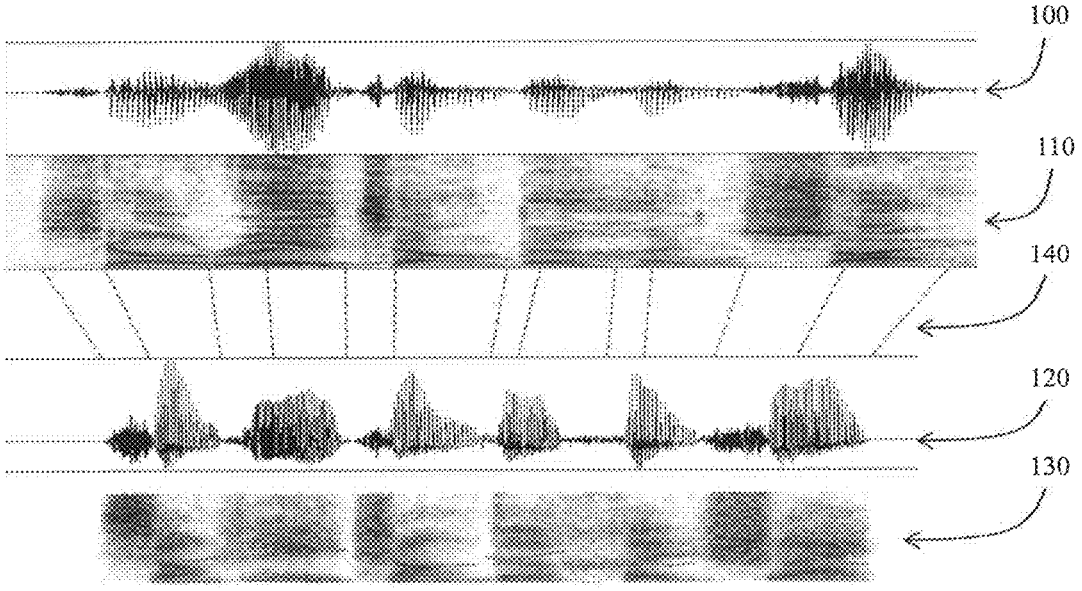
FIG. 1 shows temporal mismatch between a speech signal from a representative speaker and TTS output.

The words spoken in the target speech data are converted to a string of text which is provided as input into the TTS system. The TTS system outputs 415 is a synthetic voice speaking those words present in the target speech data but in a generic, unnatural sounding voice. As described above, each pair of onset and rime is identified and the onset and rime durations, $\{d_{tts_o}, d_{tts_r}\}$, determined 420. In general, there are often significant differences between the durations of the target speech data and the TTS output, as point out in context of FIG. 1.

Next, a scaling factor is computed 425 for each pair of onset and rime. The initial scaling factor for an onset is computed as follows:

$$S_o = \frac{d_{spk_o} + 0.005}{d_{tts_o} + 0.005},$$

While the initial scaling factor for a rime is given by:

$$S_r = \frac{d_{spk_r} + 0.005}{d_{tts_r} + 0.005}.$$

An initial scaling factor may be too high or too low to be useful where the target speech data is very noisy. To avoid spurious results, the value of onset scaling factors ($S_o$) and rime scaling factors ($S_r$) may be limited within the range of (0.5 to 2.0) and (0.3 to 3.0), respectively, using the following functions:

$$S_o = \max(0.5, \min(S_o, 2.0)),$$

$$S_r = \max(0.3, \min(S_r, 3.0)).$$

Upon completion, there will be two scaling factor for each syllable comprising an onset and a rime.

Next, a linguistic feature vector (x) is computed 430 for each syllable. The linguistic feature vector is constructed based on attributes that characterize the syllable as well as the syllable's context in the sentence. In this embodiment, the context includes attributes characterizing a preceding syllable as well as a subsequent syllable, although this context may vary depending on the application. In the preferred embodiment, the linguistic feature vector consists of the following six parts:

1. Group ID vector for onsets and rimes in the current syllable;
2. Group ID vector for onset and rime in the syllable immediately preceding the current syllable;
3. Group ID vector for onset and rime in the syllable immediately following the current syllable;
4. Tone of the current syllable;
5. Tone of the syllable immediately preceding the current syllable; and
6. Tone of the syllable immediately following the current syllable.

The group ID vector comprises one or more numerical values assigned to a phoneme or phoneme combination based on one or more categories of attributes. In the preferred embodiment, the group ID for an onset is selected from TABLE 1 in FIG. 5. TABLE 1 consists of a look up table that associates each possible onset with a designated group number. The group number ranges between zero and ten, yielding eleven different categories of onset phonemes. The members of a category possess similar onset sounds, while different categories exhibit different onset sounds.

In the preferred embodiment, the group ID for a rime is based on three attributes consisting of phoneme "voicing", phoneme "complexity", and the "nasality" of the phoneme. The "voicing" attribute is associated with categories that are assigned values ranging between 0 and 10, effectively binning rimes into one of eleven groups of similar phonemes. The bins for the voicing attribute are organized and numbered based on the similarity of the rimes' formants in their spectral representations. The "complexity" attribute is associated with categories that are assigned values ranging between 0 and 2, effectively binning rimes into one of three groups of similar phonemes. The bins for the complexity attribute are numbered based on the number of vowels in the rimes. The "nasality" attribute is associated with categories that are assigned values ranging between zero and two, effectively binning rimes into one of three groups of similar phonemes. The bins for the nasality attribute include a value of 0 where the phoneme possesses no nasality, a value of 1 where the phoneme ends in the "N" sound, and a value of 2 where the phoneme ends in the "NG" sound.

In the preferred embodiment, the group ID for a rime is selected from TABLE 2A or 2B in FIG. 5. Both TABLE 2A or 2B are lookup tables associating each rime with a value for each of the voicing, complexity, and nasality attributes. As one skilled in the art will appreciate, the numerical range and number of attributes may vary depending on the amount of target speech available for training as well as the application.

The numerical values assigned to these group ID attributes are intelligently selected to limit the variability or range of attribute values. This operation effectively reduces the dimensionality of the attributes into a limited number of clusters or groups, each group consisting of similar data types. As a result, similar sounding onsets and rimes may be used to predict the scaling factor for various onsets and rimes even when those particular onsets and rimes are absent from the corpus derived from the target speech data. That is to say, the present invention enables the speech to be time scaled more accurately despite the availability of less training data or incomplete training data.

By way of example, the group id vectors for the syllable D-AH in the sequence ZH, A-NG, D, AH, H, AH-N are [1], [1,0,0], [7], [1,0,1], [2], and [1,0,1], respectively. In this sequence, D-AH represents the current syllable, ZH and A-NG represent the syllable immediately preceding the current syllable, and H and AH-N represent the syllable immediately following the current syllable. The group ID vectors for onset D and rime AH are given by [1] and [1,0,0], respectively. Similarly, the group ID vectors for onset and rime of the preceding syllable are [7] and [1,0,2], respectively, while the group ID vectors for onset and rime of the following syllable are [2] and [1,0,1], respectively. Therefore, the linguistic feature vector for syllable D-AH includes all group ID vectors: [1], [1,0,0], [7], [1,0,1], [2], and [1,0,1].

With regard to tones, there are five possible tones: 0, 1, 2, 3 and 4, which are readily available in a standard Chinese pronunciation dictionary and known to those of ordinary skill in the art. For the syllable D-AH, the tones of the current syllable, preceding syllable, and following syllable are 3, 2, and 3, respectively. After concatenating all group ID vectors and tones, the linguistic feature vector (x) for syllable D-AH is given by [1,1,0,0, 7,1,0,2, 2,1,0,1, 3,2,3].

Once the linguistic feature vector (x), and onset and rime scale factors ($S_o$ and $S_r$) are extracted for all the syllables, the linguistic feature vector and scale factors are associated with one another 435 using a neural network or other model that can estimate $S_o$ and $S_r$ for a given linguistic feature vector (x). In the preferred embodiment, two regression trees are generated, one for estimating onset scaling factor ($S_o$) and another for estimating rime scaling factor ($S_r$). In particular, a Gradient Boosting Regression Tree (GBRT) is developed using each linguistic feature vector as the input and the corresponding scaling factors ($S_o$ and $S_r$) as the output.

Once the regression trees are trained, they may be used to estimate scaling factors for sequences of target text. First, the sequence of text is received 440 as output from the user directly or from the TTS system which, in turn, may have been generated from an audio sequence provided by a user via mobile phone, for example. The onset and rime are then identified 445 for each of the second plurality of words in the target text. A linguistic feature vector is then generated 450 for each syllable based on the pairs of identified onsets and rimes. Using the GBRT, the linguistic feature vector of each of the second plurality of words is used to estimate 455, look up, or otherwise retrieve an onset scaling factor and rime scaling factor for each syllable. The durations of the syllables of synthetic speech are then identified 465 and those durations compressed or expanded 470 using the respective onset scaling factor and rime scaling factor. The modification of the time scale of the audio frames of the synthetic speech may be modified using any of a number of time-warping techniques known to those skilled in the art. The modified speech is then used to generate 475 a waveform and made available to the user to playback 480 via the speaker in a mobile phone, for example. As one skilled in the art will appreciate, the modified synthetic speech now resembles the voice and exhibits the speech patterns of the target speaker.

Illustrated in FIG. 6 is a functional block diagram of the TTS speech personalization system 600 of the preferred embodiment. The system is configured to receive target speech data, i.e., training speech, from a user's mobile phone 670, for example, as well as a synthetic speech from the TTS system 680 comprising the same words present in the training speech. The TTS speech personalization system 600 comprises an onset/rime identification module 610, a module for generating linguistic feature vectors 620, a first database of scaling factors 630, a second database of lookup tables of group ID's 640, a first and second Gradient Boosting Regression Tree (GBRT) 650, and a compression/expansion module 660.

The onset/rime identification module 610 then identifies pairs of onsets and rimes for each of the words in the training speech and synthetic speech, as well as the durations of those onsets and rimes. The durations of the onsets and rimes are then used to generate onset and rime scaling factors, which are retained in the scaling factors database 630.

Linguistic feature vectors are also generated to characterize each pair of onset and rime in the training speech based on attributes of the syllable as well as the context of the syllable. As described above, the linguistic feature vectors effectively classify syllables into a limited number of clusters or groups based on the voicing, complexity, and nasality attributes of the syllable and context. The Group ID's are retained in the Group ID database 640.

The speech personalization system further includes two GBRT's 650 that associate the onset and rime scaling factors with the linguistic feature vectors. In particular, the system 600 includes a first GBRT trained to estimate an onset scaling factor based on a given linguistic feature vector, and a second GBRT trained to estimate a rime scaling factor based on a linguistic feature vector. Together, the first and second GBRT's 650 generate the two scaling factors necessary to modify the duration of a syllable from the default duration in the generic synthetic voice to the specific duration that matches the target speaker's speech pattern, thus enabling the speech personalization system 600 to tailor the speech to a specific speaker.

In operation, a user may speak into the microphone 672 on the mobile phone 670, for example, and that speech converted into synthetic speech using the TTS 680. In other embodiments, the user taps the soft keys of a mobile phone keyboard 676 to generate text or a text message to the TTS 680 which then generates the synthetic speech. Linguistic feature vectors characterizing and/or classifying the syllables of the speech are generated and used with the first and second GBRT's to estimate scaling factors for all the onsets and rimes, respectively. The compression/expansion module 660 then applies the scaling factors to modify the time scale of the synthetic speech and produce personalized speech, which is transmitted to the user's phone 670 in the form of a waveform file that may be played back to the user via the phone's speaker 674.

One or more embodiments of the present invention may be implemented with one or more computer readable media, wherein each medium may be configured to include thereon data or computer executable instructions for manipulating data. The computer executable instructions include data structures, objects, programs, routines, or other program modules that may be accessed by a processing system, such as one associated with a general-purpose computer or processor capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system. Examples of mass storage devices incorporating computer readable media include hard disk drives, magnetic disk drives, tape drives, optical disk drives, and solid state memory chips, for example. The term processor as used herein refers to a number of processing devices including personal computing devices, servers, general purpose computers, special purpose computers, application-specific integrated circuit (ASIC), and digital/analog circuits with discrete components, for example.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

I claim:

1. A method of personalizing synthetic speech from a text-to-speech (TTS) system, the method comprising:

recording with a microphone target speech data, wherein the target speech data comprises a first plurality of words, each of the first plurality of words comprising an onset and a rime;

identifying pairs of onsets and rimes for the first plurality of words;

determining, from the target speech data, durations of the plurality of onsets and rimes for the first plurality of words;

generating synthetic speech data based on the target speech data, wherein the synthetic speech data comprises the first plurality of words, each of the first plurality of words comprising an onset and a rime;

determining, for the synthetic speech data, durations of the plurality of onsets and rimes for the first plurality of words;

generating a plurality of onset scaling factors, each onset scaling factor corresponding to one of the first plurality of words and based on a ratio between:

a) a duration of an onset for the word in the target speech data, and b) a duration of an onset for the word in the synthetic speech data;

generating a plurality of rime scaling factors, each rime scaling factor corresponding to one of the first plurality of words and based on a ratio between:

a) a duration of a rime for the word in the target speech data, and b) a duration of a rime for the word in the synthetic speech data;

generating a linguistic feature vector for each of the first plurality of words, each linguistic feature vector comprising at least one feature attribute;

associating the linguistic feature vector for each of the first plurality of words with one of the plurality of onset scaling factors and one of the plurality of rime scaling factors;

receiving target text with a user; wherein the target text comprises a second plurality of words, each of the second plurality of words comprising an onset and a rime;

identifying pairs of onsets and rimes for the second plurality of words;

generating a linguistic feature vector for each of the second plurality of words, each linguistic feature vector comprising at least one feature attribute;

for each of the second plurality of words, identifying one of the plurality of onset scaling factors and one of the plurality of rime scaling factors based on the linguistic feature vector associated with the one of the second plurality of words;

generating synthetic speech based on the target text, wherein the synthetic speech comprises the second plurality of words, each of the second plurality of words comprising an onset and a rime;

determining, from the synthetic speech, durations of the plurality of onsets and rimes for the second plurality of words;

compressing or expanding the duration of the onset and rime for each of the second plurality of words in the synthetic speech based on the identified onset scaling factor and rime scaling factor associated with one of the second plurality of words;

generating a waveform from the onsets and rimes with compressed or expanded durations; and playing the waveform to a user.

2. The method of claim 1, wherein the synthetic speech data consists of Chinese Mandarin speech.

3. The method of claim 2, wherein each linguistic feature vector is associated with a current syllable and comprises a least one rime feature attribute, wherein the at least one rime feature attribute comprises a voicing attribute.

4. The method of claim 3, wherein a value associated with the voicing attribute is selected from one of a plurality of voicing categories, each of the plurality of voicing categories associated with different positions of rime formants in a frequency domain.

5. The method of claim 4, wherein the plurality of voicing categories comprises between 5 and 15 categories.

6. The method of claim 5, wherein the at least one rime feature attribute further comprises a complexity attribute.

7. The method of claim 6, wherein a value associated with the complexity attribute is selected from one of a plurality of complexity categories, each of the plurality of complexity categories associated with a number of rime vowels.

8. The method of claim 7, wherein the at least one rime feature attribute further comprises a nasality attribute.

9. The method of claim 8, wherein a value associated with the nasality attribute is selected from one of a plurality of nasality categories, each of the plurality of nasality categories associated with a type of rime consonant.

10. The method of claim 9, wherein each linguistic feature vector further comprises a least one tone attribute.

11. The method of claim 10, wherein each linguistic feature vector comprises a least one onset feature attribute, wherein the at least one onset feature attribute comprises a group ID.

12. The method of claim 11, wherein a value associated with the group ID is selected from one of a plurality of ten group ID categories.

13. The method of claim 1, wherein each linguistic feature vector further comprises an onset feature attribute and a plurality of rime feature attributes associated with a context syllable preceding the current syllable.

14. The method of claim 1, wherein each linguistic feature vector further comprises an onset feature attribute and a plurality of rime feature attributes associated with a context syllable following the current syllable.

* * * * *